United States Patent [19]

Hochfeld

[11] Patent Number: 4,852,255

[45] Date of Patent: Aug. 1, 1989

[54] DEVICE FOR OPENING A WRAPPED ROLL OF COINS

[75] Inventor: Stanley Hochfeld, Howard Beach, N.Y.

[73] Assignee: Leonard Holtz, Oceanside, N.Y.

[21] Appl. No.: 219,839

[22] Filed: Jul. 8, 1988

Related U.S. Application Data

[63] Continuation of Ser. No. 933,756, Nov. 21, 1986, abandoned.

[51] Int. Cl.[4] ..... B26B 27/00

[52] U.S. Cl. ..... 30/102; 30/91.2; 30/1

[58] Field of Search ..... 30/90.3, 95, 101, 102, 30/124; 81/3.4, 3.41, 3.44, 181, 182; 7/151, 156

[56] References Cited

U.S. PATENT DOCUMENTS

| | | | |
|---|---|---|---|
| 241,534 | 5/1881 | Glazier | 30/102 X |
| 552,490 | 12/1895 | Benecke | 30/91.2 X |
| 999,668 | 8/1911 | Montaperto | 30/102 |
| 1,977,441 | 10/1934 | Kenerson | 30/102 |
| 2,410,901 | 11/1946 | Ramsey | 30/102 |
| 2,725,774 | 12/1955 | Tekse | 30/91.2 X |
| 2,901,933 | 9/1959 | Wieser | 30/91.2 |
| 3,346,953 | 10/1967 | Wheeler | 30/95 |
| 4,017,021 | 4/1977 | Crudgington . | |
| 4,053,979 | 10/1977 | Tuthill et al. | 30/124 |
| 4,505,425 | 3/1985 | Alsup . | |

OTHER PUBLICATIONS

Brochure entitled "Safety Opener For Rolled Coins" Merrick Industries, Inc., Sunnyvale, California (Date unknown).

*Primary Examiner*—Frank T. Yost
*Assistant Examiner*—Michael D. Folkerts
*Attorney, Agent, or Firm*—Frishauf, Holtz, Goodman & Woodward

[57] ABSTRACT

A coin roll opening device receives a wrapped roll of coins therein, and comprises at least one cutter having at least one roll engaging edge which is engageable against the roll of wrapped coins. The roll of wrapped coins and the cutter are moved relative to each other while the at least one cutting edge of the cutter is forced against the wrapper. In this manner, the coin wrapper is either sliced, scored or weakened, to permit easy opening of the roll of coins.

28 Claims, 4 Drawing Sheets

DEVICE FOR OPENING A WRAPPED ROLL OF COINS

This application is a continuation of application Ser. No. 933,756, filed Nov. 21, 1986, now abandoned.

BACKGROUND OF THE INVENTION

The present invention is directed to a technique for quickly and conveniently exposing and removing coins from a wrapped roll of coins and, more particularly, to a device specifically adapted for slicing, piercing or scoring the coin wrapper to facilitate opening of the coin wrapper and removal of the coins therefrom. The devices of the present invention will be designated "coin roll openers" or merely "openers" throughout this specification and claims for convenience.

It is common practice for banks and businesses to utilize coin wrappers. The wrappers are manufactured of either paper or plastic, and in certain lengths and diameters so as to accommodate a given number of a particular coin denomination. For example, a penny wrapper is sized to have fifty pennies fitted into it. Other specially sized wrappers are available for nickels, dimes and quarters, for example. Once the coins are inserted into the wrapper, the ends of the wrapper are closed or otherwise turned under or reduced in size to insure that the contents do not spill out during handling.

In use, the wrapped rolls of coins are distributed to cashiers who must, as a matter of course, make change to customers. When the cashier runs out of a certain coin denomination, a roll of that coin denomination is opened and its contents spilled into the cash register for ready availability. How the wrapper is opened by the cashier forms the subject of the present invention.

When a cashier needs to open a wrapped roll of coins, normally it will be firmly grasped and sharply banged against an edge, typically an edge of the cash register or cashier box or a sharp edge in the money drawer. As a result of this blow to the roll of coins, the wrapper is at least partly split so that its contents can be spilled out. Although this procedure is effective, it also is problematic for both the cashier and the cash register or cashier's box. Specifically, the blow delivered to the wrapped roll of coins can result in injury to the cashier's hands from accidentally banging the fingers along with the roll against the hard, sharp edge. Also, since the cashier may need to open quite a large number of such rolls during the course of a business day, the repetition of shocks to the hands can result in injury over a long period of time. As far as the cash register, cashier's box or money drawer is concerned, these have become less sturdy and more complicated. Metal has been replaced by plastic. The latter may not be capable of withstanding over the course of time multiple repeated blows delivered by a very hard object such as a roll of metal coins. Very often the cash register housing, the cash drawers and/or coin dividers in the cash drawers are physically damaged from impact of the coin rolls. Furthermore, electronics have replaced mechanical and electromechanical elements in cash registers to perform calculations and various other sensing and data processing functions. When a coin roll is banged against any part of the cash register, shock waves travel throughout to all of its components. Such shocks may cause damage to the electronics and other shock-sensitive components of the cash register. As a direct result, excessive service calls and repairs are required to reduce cash register down time.

SUMMARY OF THE INVENTION

It is the primary object of the present invention to provide a coin roll opener for opening a roll of coins without the need to deliver a blow to the roll.

Another object of the present invention is to provide a device for opening a roll of coins safely, conveniently, and quickly.

A further object of the present invention is to provide a device for opening a roll of coins which is light and compact.

Yet another object of the present invention is to provide a device for opening a roll of coins which is relatively inexpensive.

Still another object of the present invention is to provide a device for opening a roll of coins which is sturdy and reliable.

These and other object of the present invention are obtained by a device for opening a wrapped roll of coins comprising means for receiving therein a roll of coins held within a wrapper; cutter means having at least one roll engaging edge which is engageable against the roll of wrapped coins; and means for moving said cutter means relative to the wrapped roll of coins as said at least one edge of said cutter means is forced against the wrapper.

DETAILED DESCRIPTION

Figure 1:
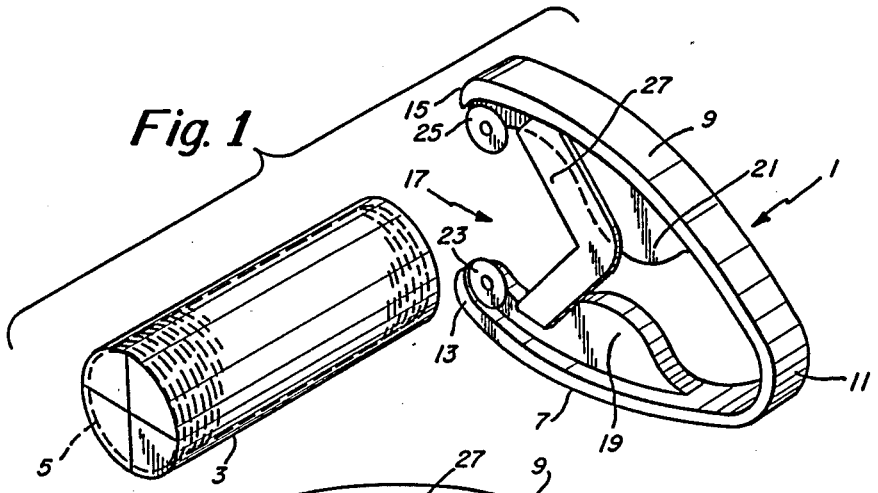
FIG. 1 is a perspective view of one embodiment of the present invention juxtaposed with a wrapped roll of coins.

FIGS. 1–4 depict a coin roll opener 1 which is used to open wrapper 3 retaining coins 5 therein. Opener 1 is a generally C-shaped member defined by fingers or arms 7 and 9 joined at end 11. The opener is made from a material such that end 11 is resilient so that fingers 7 and 9 may be compressed toward each other by a force. However, upon removal of that force, opener 1 resumes its normal shape as fingers 7 and 9 are resiliently returned to their original position. Plastic is an example of a satisfactory material for this purpose. Finger 7 has a free end 13 while finger 9 has a free end 15. An opening 17 is defined within the confines of opener 1. Extending laterally into this opening are ribs 19 and 21 attached, respectively, to fingers 7 and 9. Ribs 19 and 21 reinforce fingers 7 and 9 to provide added strength for withstanding compression forces applied to opener 1, as explained in greater detail below.

A circular cutter 23 is secured to end 13 of finger 7 while a similar cutter 25 is secured to end 15 of finger 9. Cutters 23 and 25 are preferably fixed in place. However, they can also be made rotatable around a shaft which itself is fixed to the fingers. Cutters 23, 25 have tapered coin roll engaging edges, which may be sharp or blunt.

A bar 27 is attached to finger 9 and extends transversely across opener 1 toward finger 7. Bar 27 is elbow-shaped, and is positioned so that its opening faces toward cutters 23 and 25. Bar 27 serves to position the wrapped roll of coins so that cutters 23 and 25 can slice into or weaken wrapper 3. How this is done is explained directly below.

Figure 2:
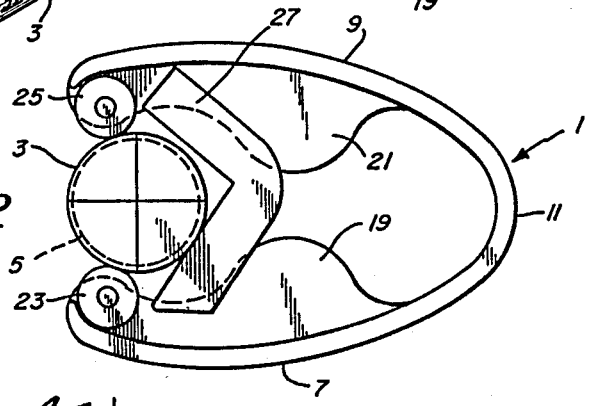
FIG. 2 is a plan view of the embodiment shown in FIG. 1 with the roll of coins inserted in the device but before the device is operated to cut the wrapper.

In operation, the roll of coins is inserted into opener 1. This can be done either by moving the roll of coins in its longitudinal direction as shown in FIG. 1 until it is accommodated within opening 17 of opener 1, or by moving the roll of coins from left to right sideways as shown in FIG. 2 so that it advances first into position between the cutters, and then further into opening 17. Either way, bar 27 limits the extent to which the roll can enter opening 17. Bar 27 also serves as a backstop for the roll as the cutters dig into it so that the roll is squeezed between the cutters 23, 25 and bar 27.

Figure 3:
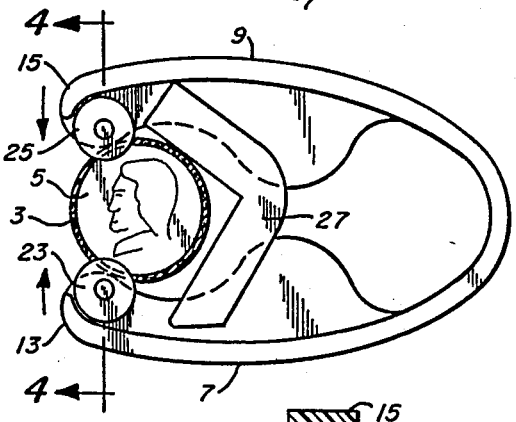
FIG. 3 is a plan view of the embodiment shown in FIG. 2 after the device is actuated to slice into the wrapper, and with part of the wrapper and its coin contents removed so that the wrapper is shown in cross section.
Figure 4:
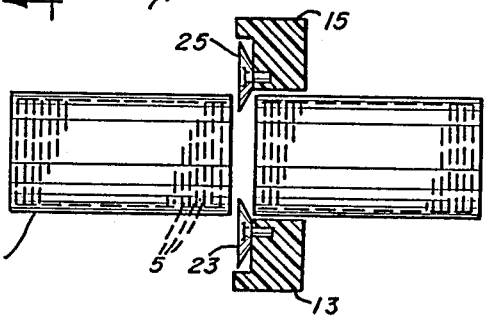
FIG. 4 is a cross-sectional view taken along line 4—4 of FIG. 3.

As the cashier inserts the roll into the opener, one hand grips fingers 7 and 9 of opener 1 while the other hand holds one end of the roll. Fingers 7 and 9 of opener 1 are then squeezed by the cashier's hand so that edges of the cutters 23, 25 slice into wrapper 3, as best shown in FIGS. 3 and 4. The tapered shape of the cutters, as best shown in FIG. 4, and the sharp (or blunt) cutting edge will tend to find an interstice between adjacent coins into which the cutters can be inserted in order to slice or weaken or score wrapper 3. Once the cutters have cut or moved into the wrapper at an interstice between adjacent coins, the cashier preferably turns the roll relative to the opener 1, or vice versa. Either one of the two can be turned. The turning action extends the cut or completes a cut (or scoring, or weakening) around the entire periphery of wrapper 3 so that it is now either in two pieces or it can easily be broken into two pieces by the operator with very little force required. Consequently, wrapper 3 has been opened and the coins can easily be removed therefrom. If the wrapper is sliced, weakened or scored only partly around its circumference, it is weakened sufficiently that it can be easily broken by manually bending the ends of the roll relative to the center portion thereof.

It is also possible to operate this device without actually cutting completely through wrapper 3. For example, if wrapper 3 is made of hard or soft plastic, cutters 23, 25 could be forced against it to score the outer surface (preferably around the center portion of the roll) and thereby weaken the wrapper wall. The wrapper can then be broken by holding it in both hands and forcing the ends to bend relative to the center portion. If wrapper 3 is made of softer plastic, cutters 23, 25 will cause the wrapper wall to deform, thereby weakening it. Preferably, however, the wrapper 3 is sliced or cut.

Figure 5:
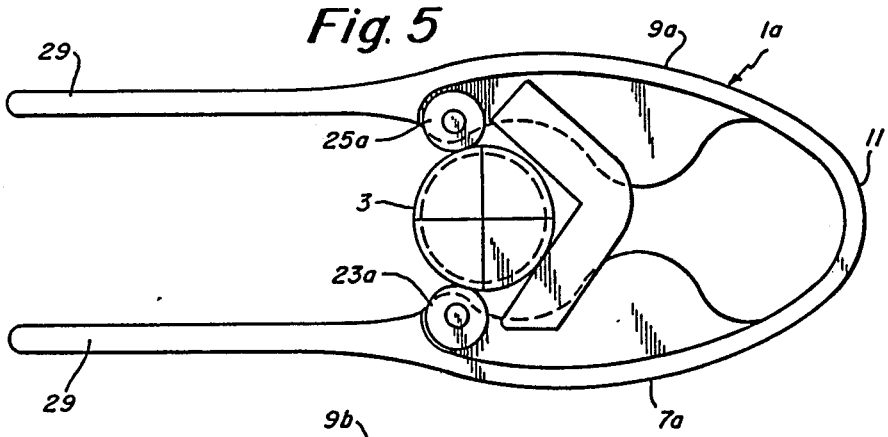
FIG. 5 is a plan view of a second embodiment of the present invention.

An extension of the above-disclosed first embodiment is a second embodiment shown in FIG. 5. FIG. 5 is substantially the same as FIG. 2. The only difference is the addition in FIG. 5 of handles 29, 29 attached, respectively, to fingers 7*a* and 9*a*. With this arrangement, rather than opener 1*a* being held in the hand of the cashier by fingers 7*a* and 9*a*, instead the cashier grasps opener 1*a* by handles 29, 29. The advantage of providing these handles is the added mechanical advantage due to the longer lever arm from the fulcrum at end 11 of opener 1*a*. With this embodiment, therefore, it is easier for the cashier to apply the force needed for cutters 23*a* and 25*a* to slice into wrapper 3 or to score or weaken the wrapper 3.

Figure 6:
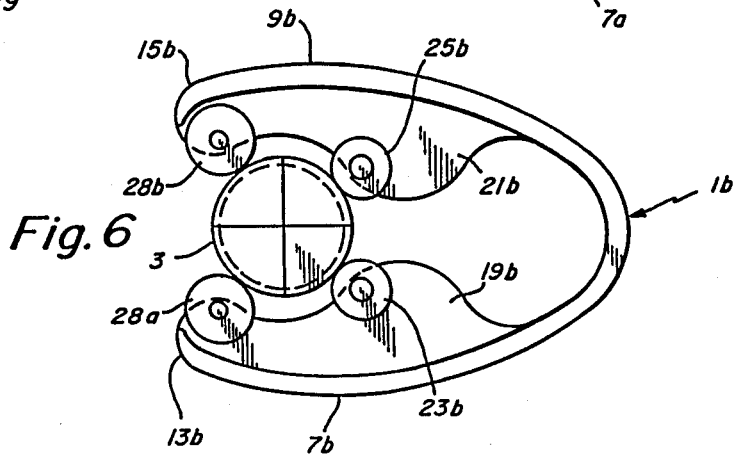
FIG. 6 is a plan view of a third embodiment of the present invention.

FIG. 6 is a third embodiment showing an opener 1*b* based generally on the same approach as that adapted for designing the opener 1 of the first and second embodiments. However, whereas cutters 23 and 25 of the previous embodiments are placed at the free end of fingers 7 and 9, with this embodiment the cutters are placed along the length of these fingers. As shown in FIG. 6, cutters 23*b* and 25*b* are attached, respectively, to ribs 19*b* and 21*b*. Cutters 23*b* and 25*b* extend into opening 17. These cutters are the same as cutters 23 and 25 of the previous embodiments, and may be rotatable or fixed. One advantage of this arrangement as compared to that of the FIG. 1 embodiment is safety. In the FIG. 1 embodiment, cutters 23 and 25 are more likely to be accidentally gripped by the cashier in picking up opener 1 or otherwise handling it or being in its proximity when opener 1 is stored in the drawer. With the FIG. 6 embodiment, however, cutters 23*b* and 25*b* are safely tucked away within opener 1*b*, and the chance that the cashier's hand will come into contact with these cutters is more remote.

Opener 1*b* of the FIG. 6 embodiment includes rollers 28*a* and 28*b* rigidly attached to ends 13*b* and 15*b* of fingers 7*b* and 9*b*, respectively. Rollers 28*a*, 28*b* function to press the roll of coins toward cutters 23*b* and 25*b* when opener 1 is operated by forcing fingers 7*b* and 9*b* together. Rollers 28*a*, 28*b* can be replaced with fixed bearing surfaces curved or otherwise arranged to press the roll toward cutters 23*b*, 25*b*. Handles similar to handles 29, 29 of FIG. 5 can be applied to the FIG. 6 embodiment.

Figure 7:
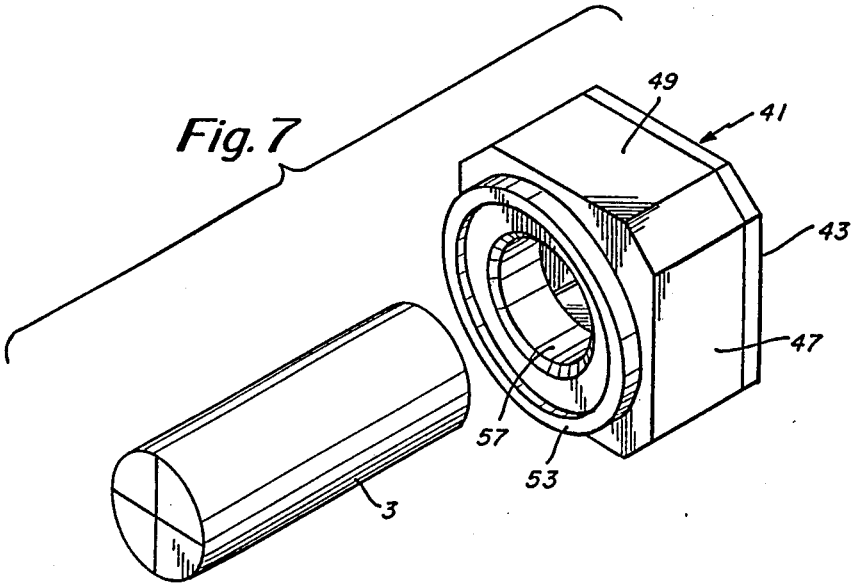
FIG. 7 is a perspective view of a fourth embodiment of the present invention juxtaposed with a wrapped roll of coins.
Figure 8:
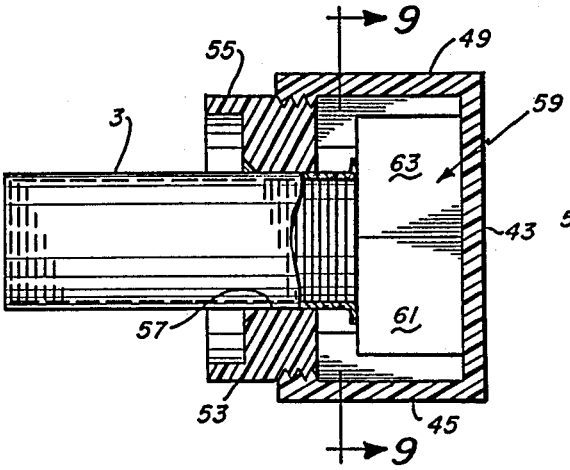
FIG. 8 is a side view in cross section of the FIG. 7 embodiment with a wrapped roll of coins inserted into the device.
Figure 9:
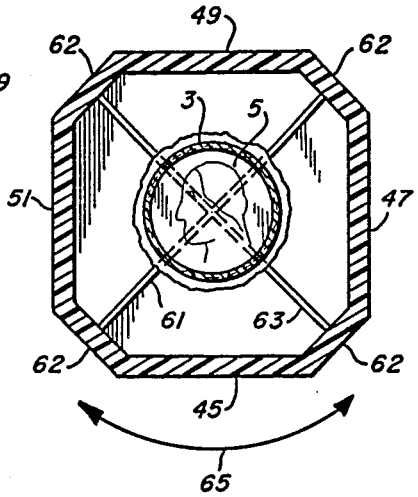
FIG. 9 is a cross-sectional view taken along line 9—9 of FIG. 8.

FIGS. 7–9 disclose a still further embodiment of the present invention. Opener 41 is comprised of a housing having a bottom 43 and side walls 45, 47, 49, and 51. One end of housing 41 opposite bottom 43 is open. Into this open end is positioned cylinder 53. One end of cylinder 53 has its outer diameter threaded. Correspondingly, the open end of housing 43 has its inner diameter threaded. Consequently, cylinder 53 can be screwed into the open end of housing 43 to complete the housing assembly of opener 41. Flange 55 is provided at the end of cylinder 53 remote from the threaded end to facilitate grasping and turning of cylinder 53. In other words, extension of cylinder 53 by flange 55 adds a gripping surface so that the cashier's fingers can readily grasp the cylinder. Cylinder 53 is also comprised of opening 57 which is sized to accommodate the largest wrapped roll of coins which is to be used by the cashier.

Opener 41 also includes a cutter assembly 59 best shown in FIGS. 8 and 9. Cutter assembly 59 includes criss-crossed blades 61 and 63. Blades 61 and 63 are firmly secured to the side walls (or bottom wall) of opener 41. One longitudinal edge of blades 61 and 63 rests on the surface of bottom 43 of the housing. The opposite longitudinal edge is a sharp cutting edge which faces opening 57.

In operation, opener 41 is held by the cashier in one hand while the other hand holds the roll of coins. One end of the roll is inserted into opening 57 and forcefully pressed against blades 61 and 63. In that position, opener 41 and roll are relatively rotated back and forth as depicted by arrow 65 in FIG. 9. Due to this rotation, blades 61 and 63 will shred open the top end of wrapper 3 to expose the leading coin retained therein. Once this is done, the cashier puts down opener 41 and shakes the coins out of opened wrapper 3 or grasps wrapper 3 at its open end and tears it a little bit to facilitate removal of the coins.

Due to the shredding of wrapper 3 by blades 61 and 63, it is likely that some paper or roll debris will accumulate within the housing of opener 41. Consequently, cylinder 53 can be removed periodically from the housing so that any paper accumulated inside can be shaked out.

In the preferred embodiment, gripping surfaces are provided on the housing of opener 41 to facilitate its rotation. Such surfaces can be projections extending radially outward from the housing. Preferably, however, such surfaces can be simply flat surfaces 62 formed at the corners where adjacent side walls meet.

The embodiment of 7–9 can be secured to the housing of a cash register, to a counter, to a wall or other convenient surface by means of an adhesive on the bottom surface 43. This type of mounting insures ready availability of the device.

Figure 10:
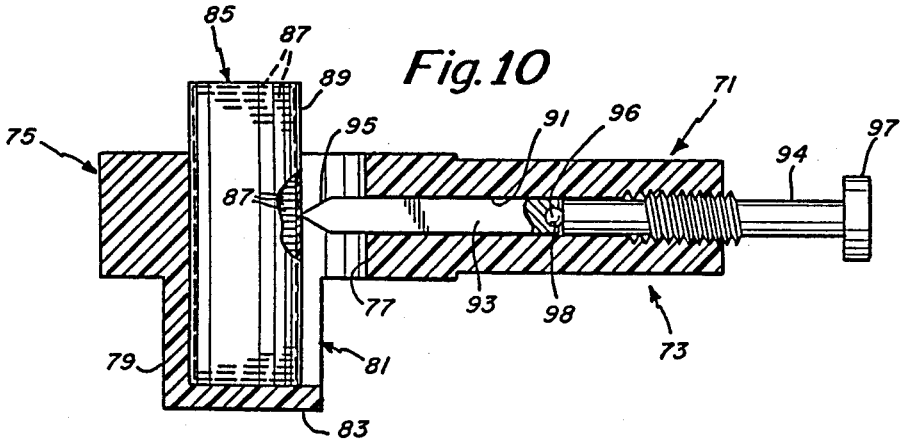
FIG. 10 is a cross-sectional view of a fifth embodiment taken along the line 10—10 of FIG. 11.
Figure 11:
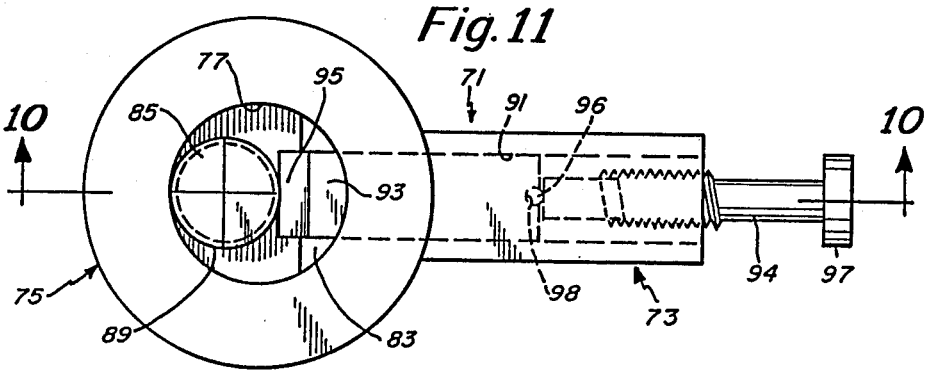
FIG. 11 is a plan view of the FIG. 10 embodiment.

A further embodiment is depicted in FIGS. 10 and 11. Coin roll opener 71 comprises handle 73 and head 75. Head 75 includes opening 77 formed therein which is sized to accommodate the largest roll of wrapped coins which can be expected to be used by the cashier. Head 75 includes an enclosure 79 depending therefrom. Enclosure 79 is hollow and has its interior aligned with opening 77 and head 75. Side 81 of enclosure 79 is open, and the rest of the enclosure is closed. Enclosure 79 is also defined by a bottom 83. A roll of coins 85 includes coins 87 contained within wrapper 89. As the wrapped roll of coins 85 is inserted into opening 77, it is further moved into enclosure 79 until one end of roll 85 rests on bottom 83.

Handle 73 of opener 71 is elongated, and contains longitudinal bores 90 and 91. Bore 91 is sized so as to accommodate flat, elongated member 93. At one end of member 93 is a cutter 95, while the other end is rotatably coupled to a rod 94. Projection on the extreme end of rod 94 snaps into recess 98 in member 93 to form a ball-and-socket arrangement. The diameter of rod 94 is substantially the same as the height of member 93 as shown in FIG. 10. The other end of rod 94 carries a knob 97.

Handle 73 at the opening to bore 91 is threaded on its interior surface to correspond with a thread provided on the exterior diameter of rod 94. With this arrangement, member 93 and rod 94 are coupled to each other and then inserted into bore 91 until the threads on the handle and rod engage each other. Knob 97 is then turned so that rod 94 continues its forward progress into bore 91. As knob 97 continues to be turned, member 93 is prevented from rotating because of its rectangular cross-section and the corresponding shape of bore 91. As rod 94 rotates, projection 96 on its end rotates freely within recess 98 of member 93. As rod 94 is moved into bore 91 by rotating knob 97, rod 94 pushes member 93 inward until cutter 95 begins to protrude into opening 77 in head 75. Further turning of knob 97 will result in the added extension of cutter 95 into opening 77. Likewise, cutter 95 can be withdrawn from opening 77 by turning knob 97 in the other direction. The ball-and-socket coupling 96, 98 serves to prevent member 93 from rattling around or even falling out of handle 73.

In operation, roll 85 is inserted into opener 71 in the manner described above. Once roll 85 rests on bottom 83 of enclosure 79, the cashier advances cutter 95 into opening 77 by turning knob 97. At some point, cutter 95 will abut against wrapper 89. Further turning of knob 97 causes cutter 95 to slice or press into wrapper 89 at an interstice between adjacent coins 87. With the cashier holding handle 73 in one hand and the upper part of roll 85 in the other hand, opener 71 and roll 85 can be rotated relative to each other so that cutter 95 travels around the entire periphery of roll 85. In this manner, wrapper 89 will be cut clean through (or scored or weakened all around the periphery thereof). Less than a full rotation can also be used to weaken the wrapper so that it can be snapped or broken open by both hands. If soft plastic coil wrappers are used, the cutter 95 can score or otherwise weaken the plastic wrapper, thereby making it easy for the operator to snap or break open the roll by bending at both ends.

Figure 12:
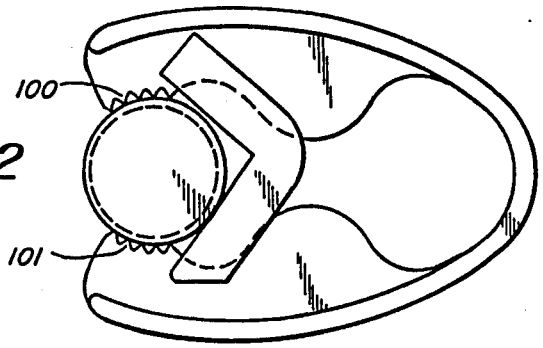
FIGS. 12 and 13 show modifications of the embodiment of FIGS. 1–4.

In all of the embodiments except the embodiment of FIGS. 7–9, the cutters may be sharp or blunt-edged. If the edges of the cutters are made very sharp, the opener device of the present invention may pose a hazard to the user. Therefore, it is preferable that the cutters have tapered blunt-edges in order to reduce the risk of injury to the user. Still further, while the cutters are shown as being metal wheels, the metal wheels can be replaced by plastic wheels, or can be fixed (not rotatable). The cutters could also be replaced by fixed position serrated edges 100, 101, for example as shown in FIG. 12. The serrated edges 100, 101 could be used in the embodiment of FIGS. 1–5, as well as in the embodiment of FIGS. 10 and 11. The serrated edges are preferably tapered toward the edges thereof (like the cutters as shown in FIG. 4) so that they can seek an interstice between adjacent coins in the roll when pressed against the roll. Also, the serrated edges, for example, as shown in FIG. 12, preferably form arcuate shapes so as to better conform to the shape of the coin roll inserted in the opener device.

Figure 13:
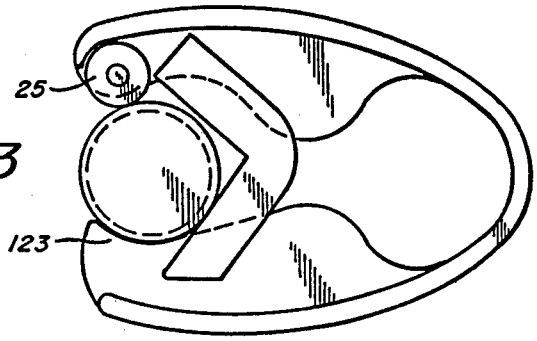

Although a number of preferred embodiments have been described in detail above, various modifications thereto will be readily apparent. For example, although the first embodiment shows two cutters 23 and 25 which slice or press into wrapper 3, only one such cutter 25 could also be used, as shown in FIG. 13. A rest or support 123 may be provided for the coin roll in place of the lower cutter. The various cutters (including the rotatable cutters) shown in the drawings may have serrated cutting or roll engaging edges. The arrangement of FIG. 13 could be reversed with the cutter on the bottom and the support 123 on the top. In addition, bar 27 could be arcuate rather than elbow shaped. Furthermore, a slot could be provided in finger 7 opposite to the free end of bar 27 so that motion of fingers 7 and 9 toward each other is not limited by the length of bar 27. In other words, the free end of bar 27 could pass through such a slot so that fingers 7 and 9 could further be compressed toward each other. Also, the inclusion of ribs 19 and 21 could be eliminated if fingers 7 and 9 are formed of a material strong enough to withstand expected compression forces. In addition, although end 11 has been disclosed as being resilient due to the material of which opener 1 is formed, a hinge could be provided at end 11 along with a spring attached to fingers 7 and 9. As to the embodiment of FIGS. 10 and 11, motion of rod 94 relative to handle 73 could be achieved without reliance on a threaded connection therebetween. Instead, rod 94 could slide freely longitudinally in bore 91. A resilient biasing means (i.e., a coil spring) would be provided between handle 73 and shaft 93 to bias cutter 95 out of opening 77. When it is desired to open a wrapper, a pushing force would be applied to knob 97 to push cutter 95 into opening 77 against the biasing force until it slices or presses into wrapper 89. These and other such modifications are all included within the scope of the present invention as defined by the following claims.

I claim:

1. A device for opening a wrapped roll of coins, comprising:

means for receiving therein a roll of coins held within a wrapper, said receiving means including a one piece molded structure having first and second elements, each element having opposite end portions, said first and second element being integrally molded and joined together only at one end portion thereof to form said one-piece structure and being spaced apart and unconnected from each other along the length thereof to form a substantially unobstructed opening passing therebetween and which extends from said joined end portions to the opposite end portions thereof, said first and second elements being relatively movable about said integrally molded and joined end portions, said joined end portions defining a hinge-like resilient connection between said elements and biasing said elements apart to form said substantially unobstructed opening therebetween which extends from said hinge-like resilient connection to said opposite end portions of said first and second elements;

said first and second elements each having inner surface portions facing inwardly of said opening, and outside surface portions facing away from said opening;

the inner surface portion of one of said first and second elements comprising a roll receiving support surface in the vicinity of said opening for engaging and supporting a wrapped roll of coins inserted in said opening between said first and second elements, and defining an abutment surface against which said roll of coins abuts during use;

cutter means on the inner surface portion of at least the other of said first and second elements and being positioned in the vicinity of said opening, said cutter means facing said roll receiving support surface and having at least one edge extending toward said support surface and which is selectively engageable against a roll of wrapped coins received in said opening and supported on said support surface, said at least one edge extending in a direction substantially transverse to the longitudinal axis of a wrapped roll of coins received in said opening;

said support surface being arranged to apply a force to a wrapped roll of coins supported thereon at least in a direction toward said at least one edge of said cutter means;

manually operable means on said outside surface portions of said first and second elements and which are manually grippable for manually squeezing together said first and second elements by a hand of a user for forcedly moving said first and second elements toward each other against said biasing force, with said wrapped roll of coins in said opening therebetween to apply a force passing through said cutter means to thereby force said at least one edge of said cutter means against said wrapper of said wrapped roll of coins to at least weaken said wrapper, in a direction substantially transverse to the longitudinal axis of said wrapped roll of coins, where said at least one edge is forced thereagainst, said wrapped roll of coins abutting against at least a portion of said abutment surface during forcing of said at least one edge against said wrapper; and force applying means on at least one of said first and second elements and located adjacent said abutment surface on the side of said support means closest to said joined end portions of said first and second elements for applying a force to said wrapped roll of coins when said first and second elements are squeezed together, said applied force having a component in a direction passing between said first and second elements.

2. The device of claim 1, wherein said at least one edge of said cutter means is a sharp edge.

3. The device of claim 1, wherein said cutter means comprises at least one rotatable cutter element having said at least one edge.

4. The device of claim 1, wherein said cutter means comprises at least one fixed cutter element having a fixed roll engaging edge.

5. The device of claim 4, wherein said fixed roll engaging edge is a serrated edge.

6. The device of claim 1, wherein said cutter means is positioned on at least one of said first and second elements intermediate said ends of said first and second elements.

7. The device of claim 6, wherein said support surface comprises at least one roller mounted on at least one of said first and second elements.

8. The device of claim 7, wherein said cutter means comprises a fixed roll engaging edge.

9. The device of claim 1, wherein said cutter means comprises a cutting surface facing and extending into said opening.

10. The device of claim 1, wherein said cutter means comprises a roller having said roll engaging edge thereon.

11. The opening device of claim 1, wherein said support surface is a fixed surface which is substantially flat in the longitudinal direction of said wrapped roll of coins to prevent pivoting of said wrapped roll of coins about said support surface, and being devoid of cutting means.

12. The device of claim 1, wherein said support surface has an arcuate or curved shape in the circumferential direction of said wrapped roll of coins to serve as a means for preventing substantial movement of a wrapped roll of coins in a longitudinal direction of said first and second elements.

13. The device of claim 1, wherein said force applying means comprises positioning, support and force generating means arranged in said opening between said first and second elements and extending in a direction from said first to said second element for engaging said wrapped roll of coins when said first and second elements are moved toward each other and for generating said force on said wrapped roll of coins having a component in a direction passing between said first and second elements of the device.

14. The device of claim 13, wherein said force generated by said force applying means is in a direction passing between said first and second elements of the device.

15. The device of claim 1, wherein said manually operable means on said outside surface of said first and second elements are aligned with said at least one cutting means and said support means, in the direction of said squeezing force.

16. A device for opening a wrapped roll of coins, comprising:

means for receiving therein a roll of coins held within a wrapper, said receiving means including a one piece molded structure having first and second elements, each element having opposite end portions, said first and second elements being integrally molded and joined together at one end portion thereof to form said one-piece structure and being spaced apart from each other along the length thereof to form an opening therebetween, said first and second elements being relatively movable about said integrally molded and joined end portions, said joined end portions defining a hinge-like resilient connection between said elements and biasing said elements apart to form said opening therebetween;

a wrapped roll of coins being insertable in said opening between said first and second element;

cutter means on both of said first and second elements and being positioned in the vicinity of said opening, said cutter means facing each other on opposite sides of said opening, each cutter means having at least one roll engaging edge extending inwardly toward said opening and which is selectively engageable against a roll of wrapped coins received in said opening;

manually grippable surface means on said first and second elements in the vicinity of said cutter means and on opposite sides from said cutter means so as to face outwardly away from said opening and not to extend into said opening, said surface means being manually grippable for manually forcedly moving said first and second elements toward each other against said biasing force by means of forces applied only from outside said opening, with said wrapped roll of coins in said opening therebetween, to apply a force passing through said cutter means to thereby manually force said at least one edge of each of said cutter means against said wrapper of said wrapped roll of coins to at least weaken said wrapper where said at least one of said edges are forced thereagainst; and positioning, support and force generating means arranged in said opening between said first and second elements and extending in a direction substantially transverse to said first and second elements for engaging said wrapped roll of coins when said first and second elements are moved toward each other and for generating a force on said wrapped roll of coins having a component in a direction passing between said first and second elements of the device.

17. The device of claim 16, wherein said positioning, support and force generating means comprises a bar means attached to one of said elements and extending toward the other of said elements in the vicinity of said opening, said bar means being positioned so as to be spaced from said cutter means by a distance which can accomadate said wrapped roll of coins therein with said wrapped roll of coins abutting said bar means, said bar means including means for applying said force to a wrappped roll of coins abutting thereagainst, said force having a component in said direction passing between said first and second elements.

18. The device of claim 17, wherein said bar means is curved to define an opening toward said cutter means.

19. The device of claim 17, wherein said bar means extends substantially transversely to said first and second elements.

20. The device of claim 17, wherein said force applied by said bar means is in a direction passing between said first and second elements of the device.

21. The device of claim 16, wherein said force generated by said positioning, support and force generating means is in a direction passing between said first and second elements of the device.

22. The device of claim 16, wherein said manually operable means on said outside surface of said first and second elements are aligned with said at least one cutting means and said support means, in the direction of said squeezing force.

23. A device for opening a wrapped roll of coins, comprising:

means for receiving therein a roll a coins held within a wrapper, said receiving means including a one piece molded structure having first and second elements, each element having opposite end portions, said first and second elements being integrally molded and joined together only at one end portion of each of said first and second elements to form said one-piece structure and being spaced apart from each other along the length thereof to form an opening therebetween, the opposite end portions of said first and second elements being relatively movable about said integrally molded and joined end portions, said joined end portions defining a hinge-like resilient connection between said elements and biasing said elements apart to form said opening therebetween which extends from said free ends thereof;

one of said first and second elements comprising a roll receiving support means in the vicinity of said opening for engaging and supporting a roll of coins inserted in said opening between said first and second elements, and defining an abutment means against which said roll of coins abuts during use;

cutter means on at least the other of said first and second elements and being positioned in the vicinity of said opening, said cutter means facing said roll receiving support means and having at least one edge extending toward said support means and which is selectively engageable against a roll of coins received in said opening and supported on said support means;

said support means being arranged to apply a force to a wrapped roll of coins supported thereon at least in a direction toward said cutter means;

manually operable means, on said first and second elements, which are manually grippable for forcedly and manually moving said first and second elements toward each other against said biasing force, with said wrapped roll of coins in said opening therebetween to thereby force said at least one edge of said cutter means against said wrapper of said wrapped roll of coins to at least weaken said wrapper where said at least one edge is forced thereagainst, said wrapped roll of coins abutting against said abutment means during forcing of said at least one edge against said wrapper; and force applying means on one of said first and second elements and extending toward the other of said first and second elements in the vicinity of said opening, said force applying means being positioned adjacent said support means on the side of said support means closest to said joined end portions of said first and second elements so as to accommodate said wrapped roll of coins between said cutter means and said support means with said wrapped roll of coins abutting said force applying means, said force applying means including means for applying a force to a wrapped roll of coins abutting thereagainst in a direction passing between said first and second elements.

24. The device of claim 23, wherein said support means comprises a support surface which has an arcuate or curved shape in the circumferential direction of said wrapped roll of coins to serve as a means for preventing substantial movement of a wrapped roll of coins in a longitudinal direction of said first and second elements.

25. The device of claim 23, wherein said force applying means extends from said support means in a direction toward said cutter means, and is curved to define an opening in cooperation with said support means, which opening faces towards said cutter means, for receiving a wrapped roll of coins therein.

26. The device of claim 25, further comprising respective handles affixed to said elements and extending from the other end portions thereof opposite from said joined end portions end extending in a direction away from said joined end portions.

27. A device for opening a wrapped roll of coins, comprising:

means for receiving therein a roll of coins held within a wrapper, said receiving means including a one piece molded structure having first and second elements, each element having opposite end portions, said first and second elements being integrally molded and joined together only at one end portion thereof to form said one-piece structure and being space apart and unconnected from each other along the length thereof to form a substantially unobstructed opening passing therebetween and which extends from said joined end portions to the opposite end portions thereof, said first and second elements being relatively movable about said integrally molded and joined end portions, said joined end portions defining a hinge-like resilient connection between said elements and biasing said elements apart to form said substantially unobstructed opening therebetween which extend from said hinge-like resilient connection to said opposite end portions of said first and second elements;

one of said first and second elements comprising a roll receiving support surface in the vicinity of said opening for engaging and supporting a roll of coins inserted in said opening between said first and second elements, and defining an abutment surface against which said roll of coins abuts during use;

cutter means on at least the other of said first and second elements and being positioned in the vicinity of said opening, said cutter means facing said roll receiving support surface and having at least one edge extending toward said support surface and which is selectivity engageable against a roll of wrapped coins received in said opening and supported one said support surface;

said support surface being arranged to apply a force to a wrapper roll of coins supported thereon at least in a direction toward said cutter means;

said first and second elements having outside surface portions facing away from said opening;

manually operable means on said outside surface portions of said first and second elements and which are manually grippable for manually squeezing together said first and second elements for forcedly moving said first and second elements toward each other against said biasing force, with said wrapped roll of coins in said opening therebetween to apply a force passing through said cutter means to thereby force said at least one edge of said cutter means against said wrapper of said wrapped roll of coins to at least weaken said wrapper where said at least one edge is forced thereagainst, said wrapped roll of coins abutting against said abutment means during forcing of said at least one edge against said wrapper; and positioning, support and force generating means arranged in said opening between said first and second element and extending in a direction from said first to said second element for engaging said wrapped roll of coins when said first and second elements are moved toward each other and generation a force on said wrapped roll of coins having a component in a direction passing between said first and second elements of the device.

28. The device of claim 27, wherein said force generated by said positioning, support and force generating means is in a direction passing between said first and second elements of the device.

* * * * *